US005943891A

United States Patent [19]

Takagi et al.

[11] Patent Number: 5,943,891

[45] Date of Patent: Aug. 31, 1999

[54] SILENCER SHELL FORMING APPARATUS

[75] Inventors: Kazuaki Takagi; Yukinori Suzuki, both of Nagoya, Japan

[73] Assignees: Sango Co., Ltd.; Sanko Seiki Co., Ltd., both of Nagoya, Japan

[21] Appl. No.: 08/976,483

[22] Filed: Nov. 24, 1997

[30] Foreign Application Priority Data

Nov. 28, 1996 [JP] Japan ..... 8-317255

[51] Int. Cl.[6] ..... B21D 39/02; E05B 19/00

[52] U.S. Cl. ..... 72/51; 72/393

[58] Field of Search ..... 72/50, 51, 452.8, 72/452.9, 482.1, 482.2, 482.3, 482.4, 454, 392, 393

[56] References Cited

U.S. PATENT DOCUMENTS

| | | | |
|---|---|---|---|
| 1,777,316 | 10/1930 | Kuffner . | |
| 2,226,078 | 12/1940 | Spahn . | |
| 3,077,916 | 2/1963 | Vaughn | 72/393 |
| 3,986,383 | 10/1976 | Petteys | 72/393 |
| 4,207,453 | 6/1980 | Astill . | |
| 4,513,596 | 4/1985 | Usher | 72/51 |

FOREIGN PATENT DOCUMENTS

| | | |
|---|---|---|
| 1-18524 | 1/1989 | Japan . |
| 4-104237 | 9/1992 | Japan . |
| 06170474 | 6/1994 | Japan . |
| 6-170474 | 6/1994 | Japan . |
| 6-77905 | 11/1994 | Japan . |

OTHER PUBLICATIONS

"Shell Lockseaming And Flanging Silencer Manufacturing Machines", Eagle Catalogue 920–80, 1984.

*Primary Examiner*—Joseph J. Hail, III
*Assistant Examiner*—Rodney Butler
*Attorney, Agent, or Firm*—Pillsbury Madison & Sutro LLP

[57] ABSTRACT

In a silencer shell forming apparatus, a mandrel is divided into an upper segment and a lower segment as well as both the segments are permitted to move in a vertical direction to dispense with a setup job when a different type of a shell is formed. Further, a drive mechanism is provided to cause both the segments to move in a direction where they become nearer to each other and in a direction where they are separated from each other.

5 Claims, 8 Drawing Sheets

| NO. | NAME OF STEP | SCHEMATIC VIEW |
|---|---|---|
| 1 | FEED OF RAW MATERIAL |  |
| 2 | BENDING |  |
| 3 | FOLDING |  |
| 4 | INWARD BENDING |  |
| 5 | SEAMING OF FOLDING PORTION |  |

SILENCER SHELL FORMING APPARATUS

BACKGROUND OF THE INVENTION

1. Field of the Invention

The present invention relates to a silencer shell forming apparatus.

2. Description of the Related Art

Conventionally, shells used for silencers of internal combustion engines have been made by forming a metal sheet such as a stainless sheet and the like into a cylindrical shape having an elliptical section, oval section or the like.

An example of a manufacturing process of the silencer shell will be schematically described with reference to FIG. 9. A raw material 101 is fed by a raw material feeder until it is abutted against a stopper 103 below a mandrel 102 as shown at step No. 1; at step No. 2, presser plates 104 located at both the sides of the mandrel 102 are lifted to thereby cause the raw material 101 to be wound around the lower half of the mandrel 102 as well as both the end portions 105 of the raw material 101 to be raised; at step No. 3, the edges of both the end portions 105 of the raw material 101 are bent by bending rollers 106 disposed at the extreme end of a roll carriage in the advancing direction, that is, to the extreme end of the moving direction of the roll carriage; at step No. 4, both the end portions 105 are bent inward by forming bars 107; at step No. 5, both the end portions 105 are sequentially rolled in and subjected to lock seaming as the forming rollers 108 of the roll carriage, which are disposed along the axial direction of the mandrel 102, move forward to thereby form a shell 109; thereafter, the shell 109 having been formed into a cylindrical shape is removed from the mandrel 102.

JP-B2-07-32943 discloses a mandrel illustrated in FIG. 10 showing prior art (which is a first prior art in this description) as the mandrel used in the above forming apparatus. Further, JP-U-04-104237 discloses a mandrel illustrated in FIG. 11 (which is a second prior art in this description).

The first prior art shown in FIG. 10 is arranged such that a mandrel 201 is divided into two segments 202 and 203 in a right and left direction and they are mounted to a holder 204 from the outside thereof. The segment 202 is moved in the right and left direction by a hydraulic cylinder 205 provided with the holder 204 so that the outer peripheral length of the mandrel 201 can be varied.

The second prior art shown in FIG. 11 is arranged such that a mandrel 301 is divided into two segments in an up and down direction and the upper segment 302 is mounted to the outer periphery of a mandrel bar 303 and fixed thereto, the lower segment 304 is upward and downward movably disposed below the upper segment 302 and the lower segment 304 is moved upward and downward by an hydraulic cylinder 305 incorporated in the mandrel bar 303 so that the outer peripheral length of the mandrel 301 can be varied.

In the above prior arts, a shell is formed in such a manner that a raw material is tightly wound around the mandrel in a state that the segments are expanded and the shell is removed from the mandrel after it has been formed. Thus, an object of the prior art is to easily remove the shell from the mandrel by reducing the outer peripheral length of the mandrel by moving one of the segments in the contracting direction of the mandrel so as to form an interval between the mandrel and the shell. As a result, in this case, it suffices for one of the segments to move only in a very small distance of, for example, a few millimeters.

Incidentally, since there are various types of silencers having different capacities, shells are formed to have different outer peripheral lengths.

In the above prior art, however, the segment of the mandrel does not move a distance enough to form different types of shells, although it moves slightly. Further, since the hydraulic cylinder is disposed in the radial direction of the mandrel and moves only one of the segments, the hydraulic cylinder has a limited stroke in a narrow space and cannot greatly vary the outer peripheral length of the mandrel. Thus, the prior art cannot form the different types of the shells from the structure thereof.

Accordingly, when a shell having a different outer peripheral length is formed, a mandrel being used must be replaced with another mandrel dedicated for the shell having a different section. Thus, the previously used mandrel must be removed and a job for assembling the new mandrel is required as well as when the right to left diameter of the mandrel is varied by the replacement, the interval between presser plates for winding a raw material around the mandrel must be adjusted, by which a problem arises in that a job for changing setup is needed, an idle time is made, productivity is lowered and a manufacturing cost is increased.

SUMMARY OF THE INVENTION

To solve the above problem, an object of the present invention is to provide a shell forming apparatus capable of moving the segments of a mandrel in a large amount so that a mandrel replacing job becomes unnecessary even in the formation of a different type of a mandrel and further the adjustment of the interval between presser plates is not required.

To solve the above problem, according to a first aspect of the present invention, a silencer shell forming apparatus, in which a shell material fed below a mandrel is pushed upward at both the sides thereof and both the edges of the shell material are coupled with each other on the upper portion of the mandrel so that a shell is wound around the outer periphery of the mandrel, wherein the mandrel has an upper segment and a lower segment constituting the upper portion and the lower portion of the mandrel which upper segment and the lower segment are movable together in a vertical direction, and drive mechanism for driving the upper segment and the lower segment in a direction in which they become nearer to each other and in a direction in which they are separated from each other is provided.

In the first aspect, when the outer peripheral length of the mandrel is increased, the upper and lower segments are moved in the direction in which they are separated from each other to thereby expand the mandrel in the vertical direction. When the outer peripheral length of the mandrel is decreased, the upper and lower segments are moved in the direction in which they become nearer to each other to thereby contract the mandrel in the vertical direction.

According to a second aspect of the present invention, the silencer shell forming apparatus of the first aspect may further comprise a segment drive mechanism which includes a screw shaft disposed in the mandrel along the axial direction thereof; a cam screwed to the screw shaft and having cam surfaces which are formed to the upper surface and the lower surface of the cam and inclined upward and downward along the direction of the screw shaft; engaging portions formed to both of the segments and engaged with the cam surfaces; and rotational drive means provided for the screw shaft.

In the second aspect, the cam is moved forward or backward with respect to the axial direction of the mandrel by the normal or reverse rotation of the screw shaft to cause the upper and lower segments to move in the direction in which they become nearer to each other or in the direction where they are separated from each other by the cam surfaces and the engaging portions, so that the mandrel is expanded or contracted in the up or down direction.

According to a third aspect of the present invention, the screw shaft of the second aspect may have a left screw and a right screw engraved thereto, a cam is screwed to the right screw and another cam is screwed to the left screw, both of the cams have cam surfaces formed symmetrically with each other and both of the cams are caused to become nearer to each other and separate from each other by the rotation of the screw shaft.

In the third aspect, the pair of cams are moved so as to become nearer to each other or be separated from each other by the normal or reverse rotation of the screw shaft and thus the upper and lower segments are moved so as to become nearer to each other or be separated from each other by the cam surfaces formed to both the cams and the engaging portions to be engaged therewith, so that the mandrel is expanded or contracted in the up or down direction. The mandrel can be stably expanded and contracted by the expansion and contraction of both the segments caused by the pair of cams.

According to a fourth aspect of the present invention, guide bars are disposed to the upper portion of the end surface of the upper segment on the discharge side thereof in anyone of the first to third aspects.

In the fourth aspect, when a shell having been wound around the mandrel is discharged, the shell is discharged while being supported by the guide bars. In an arrangement in which the mandrel is not reversed, the shell is discharged by, for example, the guide bars of the upper segment, whereas in an arrangement in which the mandrel is reversed, the lower segment is located to the upper side and the shell is discharged by the guide bars thereof.

BRIEF DESCRIPTION OF THE DRAWINGS

FIG. 1 is viewed from a left side;

DESCRIPTION OF THE PREFERRED EMBODIMENT

An embodiment of the present invention will be described with reference to FIG. 1 to FIG. 7.

Figure 1:
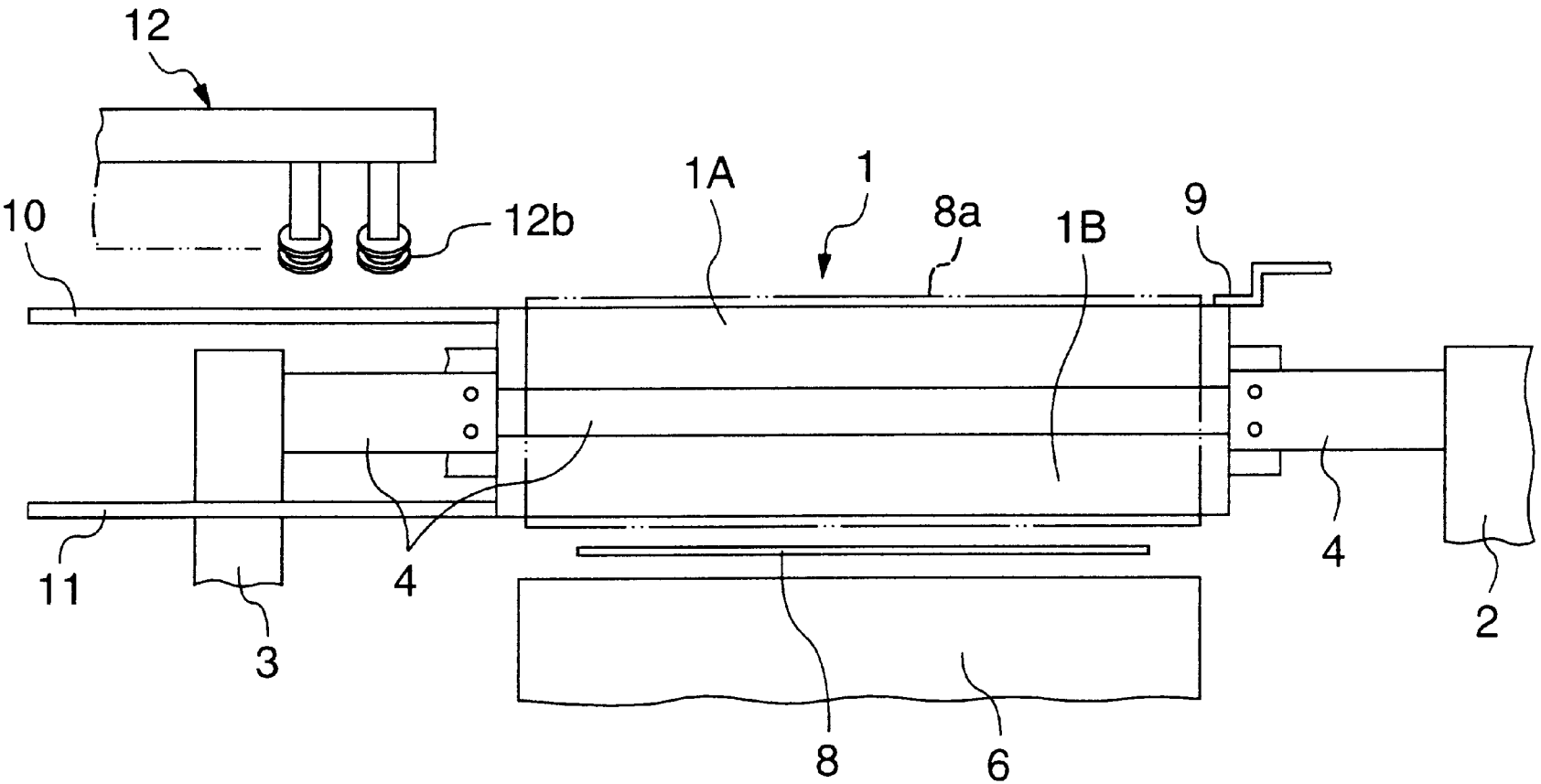
FIG. 1 is a side elevational view showing an embodiment of the present invention.
Figure 2:
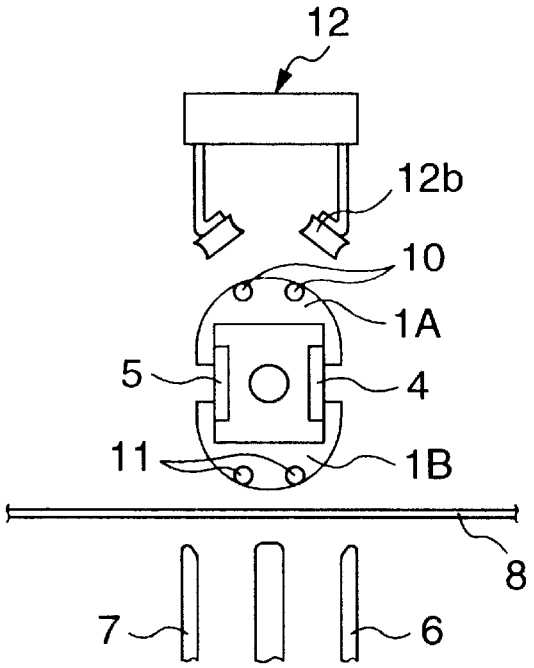
FIG. 2 is a view when

In FIG. 1, support bases 2, 3 are disposed at both the ends in a mandrel 1 and a pair of support plates 4, 5 are provided in parallel with each other between both the support bases 2, 3 as shown in FIG. 2 as well as the pair of support plates 4, 5 are rotatably supported by both the support bases 2, 3 so that, that is, the mandrel 1 can rotate about the axial center thereof.

The mandrel 1 is divided into an upper segment 1A and a lower segment 1B at the center thereof in a vertical direction and the upper segment 1A and lower segment 1B are engaged with the pair of support plates 4, 5 so as to move upward and downward.

As shown in FIG. 2, presser plates 6, 7 are upward and downward movably disposed below the mandrel 1 on both the sides thereof (on the right and left sides in FIG. 2) and moved upward and downward by not shown vertical drive means, so that a shell material 8 fed below the mandrel 1 is lifted and bent along the outer peripheral surface of the lower half of the mandrel 1, as the prior arts mentioned above.

A discharge claw member 9 is disposed on the mandrel 1 at an end thereof in a manner to move forward and backward in the axial direction of the mandrel 1 and pushes and discharges a shell having been formed by being wound around the mandrel 1 to the other end of the mandrel 1.

Guide bars 10 protrude from the upper portion of the end surface of the other end side of the upper segment 1A constituting the mandrel 1 in parallel with the axis of the mandrel 1 and guide bars 11 protrude from the lower portion of the end surface of the other end side of the lower segment 1B in parallel with the axis of the mandrel 1.

A roll carriage 12 is disposed above the mandrel 1 in a manner to move forward and backward along the axial direction of the mandrel 1 and moved forward and backward by not shown drive means. The roll carriage 12 has a well-known arrangement and is composed of a group of rollers 12*b* for sequentially folding and tightly seaming both the edges of the shell material 8 having been wound around the lower half of the mandrel 1.

Next, the mandrel 1 and its drive mechanism will be described in details with reference to FIG. 3 to FIG. 7.

Figure 5:
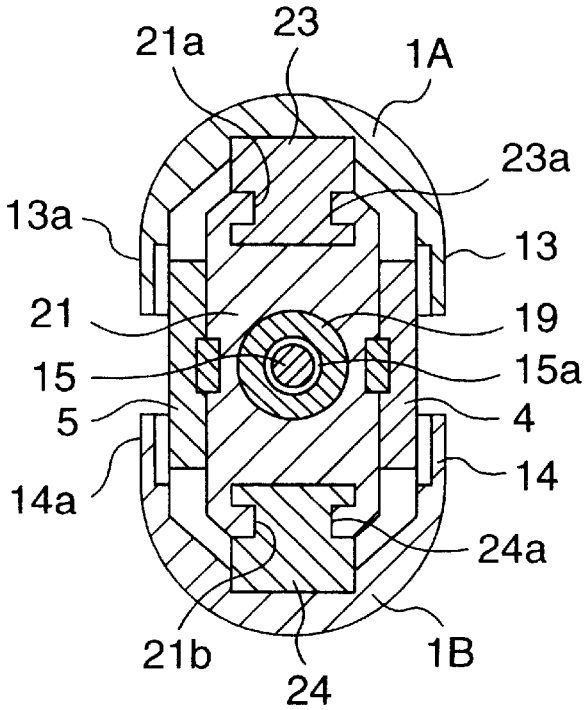
FIG. 5 is a sectional view taken along the line V—V in FIG. 3.
Figure 3:
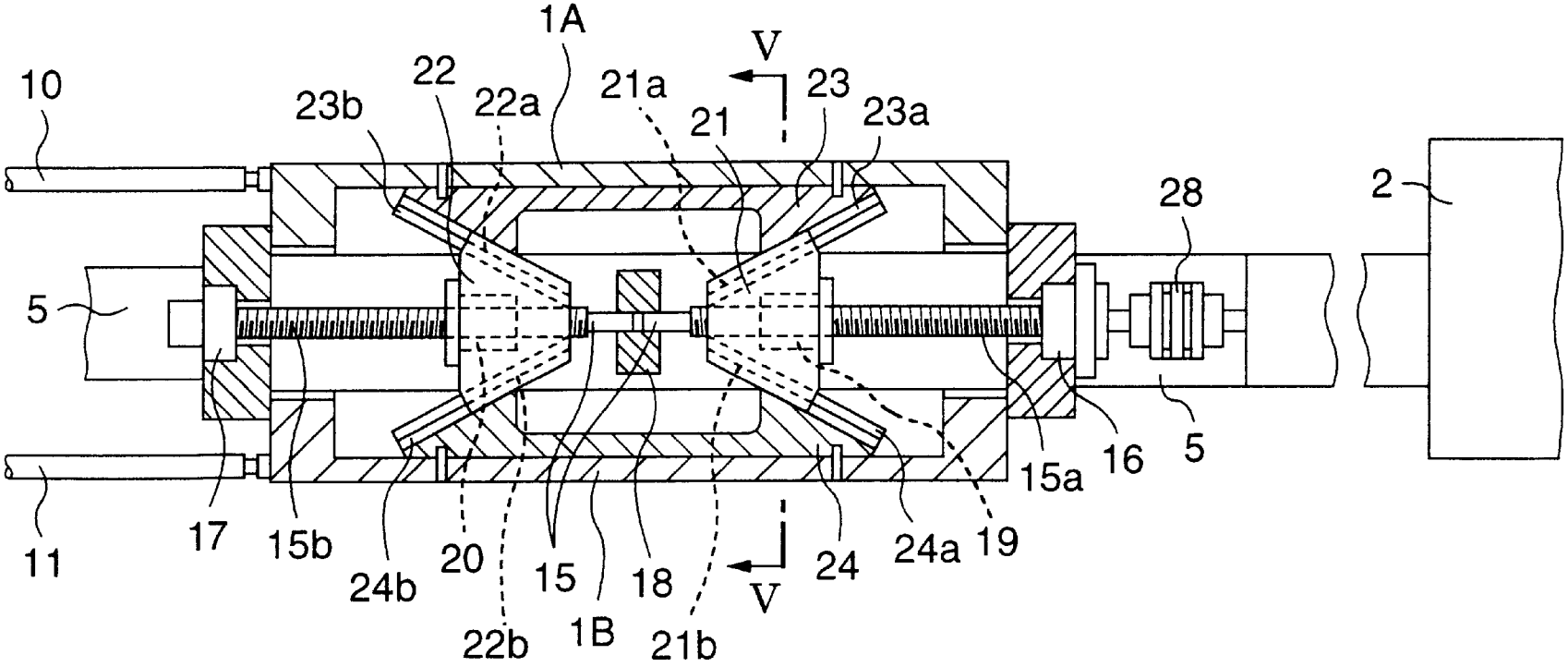
FIG. 3 is a side sectional view of a mandrel according to the present invention and shows an expanded state of the mandrel.
Figure 4:
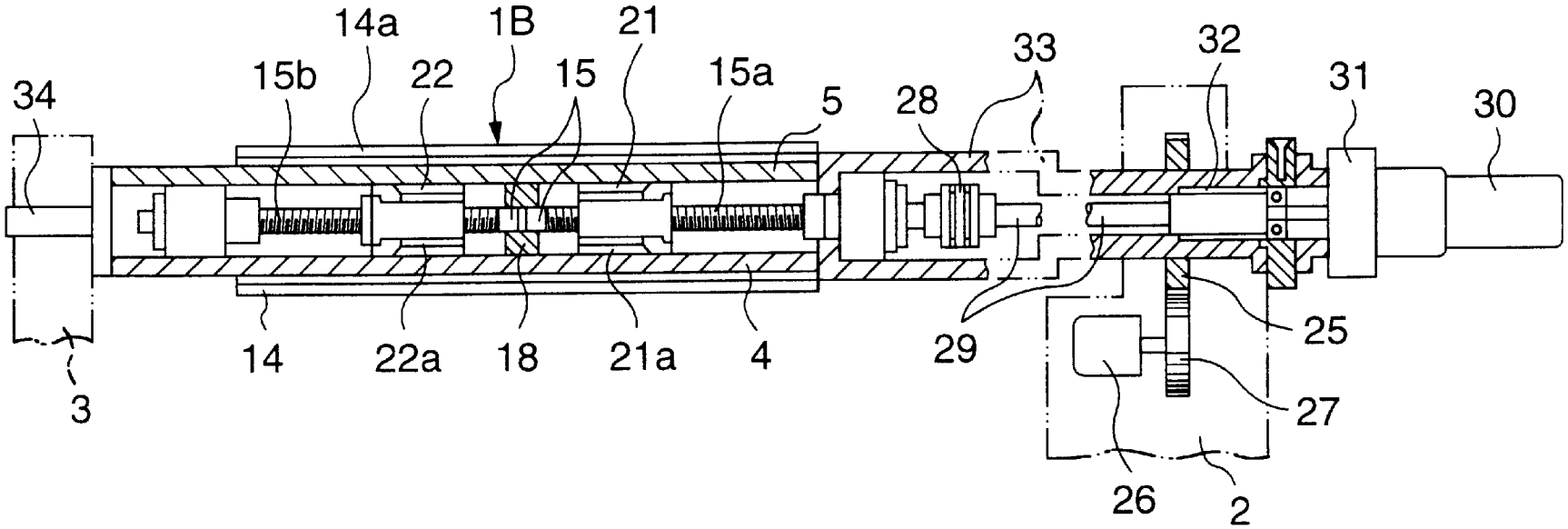
FIG. 4 is a plan sectional view of the mandrel in FIG. 3.

FIG. 3 is a vertical sectional view of the mandrel 1 when viewed from the same side as FIG. 1, FIG. 4 is a plan sectional view in the mandrel when viewed from the upper side in FIG. 3 and FIG. 5 is a sectional view taken along the line V—V of FIG. 3.

As shown in FIG. 4, the pair of support plates 4, 5 has rotary shaft portions 33, 34 at both the ends thereof which are rotatably supported by the supports base 2, 3 on both the sides.

As shown in FIG. 5, the upper segment 1A constituting the mandrel 1 is formed to a hollow member having an approximately semi-circular section with the upper portion thereof made to a convex shape and the lower surface thereof opened. Both the side portions 13, 13*a* of the upper segment 1A are slidingly (in a vertical direction) engaged with the outer side surfaces of the pair of support plates 4, 5 so that they can move upward and downward. Likewise, the lower segment 1B is also formed to a hollow member having an approximately semi-circular section with the lower portion thereof made to a convex shape and the upper surface thereof opened as shown in FIG. 5. Both the side portions 14, 14*a* of the lower segment 1B are slidingly (in the up and down direction) engaged with the outer side surfaces of the pair of support plates 4, 5 so that they can move upward and downward.

Therefore, the joint of the upper segment 1A to the lower segment 1B results in the formation of the mandrel 1 which is divided at a center in the vertical direction and has an elliptical section with a long diameter in the vertical direction and a short diameter in a horizontal direction.

Since the upper and lower segments 1A and 1B can be formed to any desired shape, when the upper segment 1A is jointed to the lower segment 1B, the section of the resultant mandrel may have a circular shape or an oval shape.

A screw shaft 15 is disposed between the pair of support plates 4, 5 and both the ends of the screw shaft 15 protrude from both the ends of the mandrel 1. The screw shaft 15 is rotatably supported by support members 16, 17 and further tightened by a tightening member 18 at an intermediate portion thereof. Further, a left screw thread 15*a* is engraved to approximately the right half of the screw shaft 15 and a right screw thread 15*b* is engraved to approximately the left half thereof.

Ball screw portions 19, 20 are screwed to the right and left screw threads 15*a*, 15*b*, a wedge-like cam 21 is fixed to the ball screw 19 on the one side and a wedge-like cam 22 is fixed to the ball screw 20 on the other side.

The cam 21 has cam surfaces 21*a*, 21*b* composed of laterally inclined surfaces which are formed on the upper and lower surfaces thereof along the axial direction of the screw shaft 15 and cause the surface of the cam 21 confronting the surface of the cam 22 to become nearer to the screw shaft 15. Likewise, the cam 22 has cam surfaces 22*a*, 22*b* composed of laterally inclined surfaces which are formed on the upper and lower surfaces thereof along the axial direction of the screw shaft 15 and cause the surface of the cam 22 confronting the surface of the cam 21 to become nearer to the screw shaft 15. As shown in FIG. 5, the cross-section of the respective cam surfaces 21*a*, 21*b*, 22*a*, 22*b* is formed to a T-shaped groove.

The upper segment 1A has an upper bracket 23 fixed to the upper portion of the inner surface thereof and the lower segment 1B has a lower bracket 24 fixed to the lower portion of the inner surface thereof. The upper bracket 23 has engaging portions 23*a*, 23*b* which are formed to the inner surfaces of the front and rear sides thereof so as to be engaged with the cam surfaces 21*a*, 22*a*. The lower bracket 24 has engaging portions 24*a*, 24*b* which are formed to the inner surface of the front and rear sides thereof so as to be engaged with the cam surfaces 21*b*, 22*b*. As shown in FIG. 5, the cross-sections of the engaging portions 23*a*, 23*b* and 24*a*, 24*b* are formed to a T-shaped protrusion so that they are engaged with the cam surfaces 21*a*, 22*a* and 21*b*, 22*b*. Although the engaging portions slide on the cam surfaces in the direction they are formed, the engage portions are not disengaged from the cam surfaces in the direction perpendicular to the direction in which they are formed.

Next, a rotational drive mechanism for rotating the pair of support plates 4, 5 and the screw shaft 15 will be described with reference to FIG. 4.

A gear 25 is fixed to the rotary shaft portion 33 which is coupled with the pair of support plates 4, 5 and a gear 27, which is rotated by a motor as rotational drive mechanism, more specifically, by a first servo motor 26, is meshed with the gear 25. The pair of support plates 4, 5 are rotated in a normal direction and a reverse direction by the normal rotation and the reverse rotation of the first servo motor 26, so that the mandrel 1 is reversed.

An end of the screw shaft 15 is coupled with a drive shaft 29 through a coupling 28. The drive shaft 29 is normally and reversely rotated by a motor as rotational drive means, more specifically, by a normal rotation and a reserve rotation of a second servo motor 30 through a speed-reduction gear 31. Further, a lock mechanism 32 composed of an oil brake mechanism and the like is disposed to the outer periphery of the drive shaft 29, so that the rotation of the drive shaft 29 can be prevented by actuating the lock mechanism 32 at a predetermined time.

Next, a process for forming a silencer shell will be described.

FIG. 1 to FIG. 5 show a state that the upper segment 1A moves upward and the lower segment 1B moves downward and the mandrel 1 is expanded in the vertical direction.

In this state, the shell material (metal sheet) 8 is fed below the mandrel 1 as shown in FIG. 1 and FIG. 2. Thereafter, the presser plates 6, 7 move upward and push the shell material 8 upward and press it against the lower portion of the mandrel 1. The presser plates 6, 7 further move upward to thereby bend the central port of the shell material 8 along the lower half of the mandrel 1, that is, along the outer peripheral portion of the approximately semi-circular portion of the lower segment 1B. This state is similar to that shown in step No. 2 in FIG. 9.

When the shell material 8 is bent, a force for strongly pushing the lower segment 1B upward is applied thereto. The application of the pushing-up force results in a component force for moving both the cams 21, 22 in a direction in which they are separated from each other through the inclined cam surfaces 21*b*, 24*b*. When the cams 21, 22 are moved in the separating direction by the component force, a problem arises in that the screw shaft 15 is rotated and load torque is transmitted to the second servo motor 30. Accordingly, when the shell material 8 is bent, the rotation of the screw shaft 15 is prevented by actuating lock mechanism 32 to thereby protect the servo motor 30.

Figure 9:
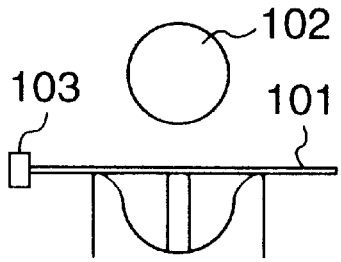
FIG. 9 is a view schematically showing a process for forming the shell of the silencer.
Figure 9:
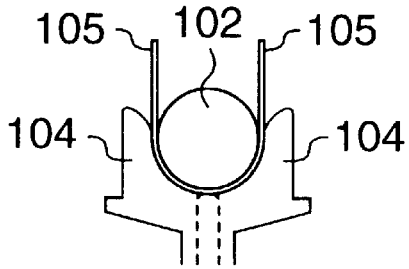
Figure 9:
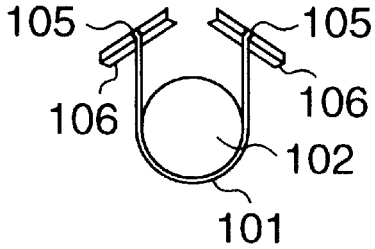
Figure 9:
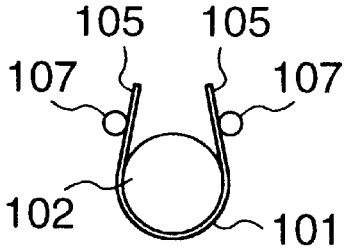
Figure 9:
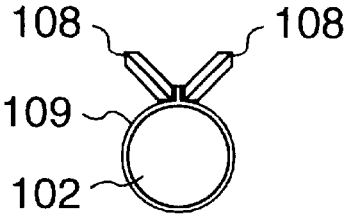
Figure 10:
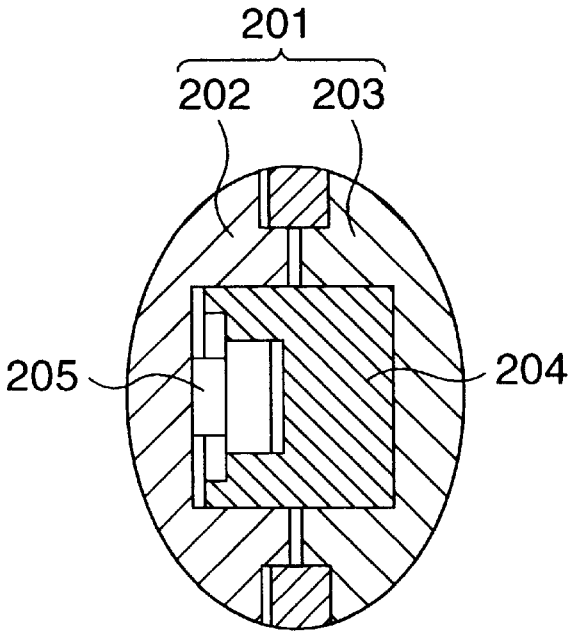
FIG. 10 is a sectional view showing a first conventional mandrel.
Figure 11:
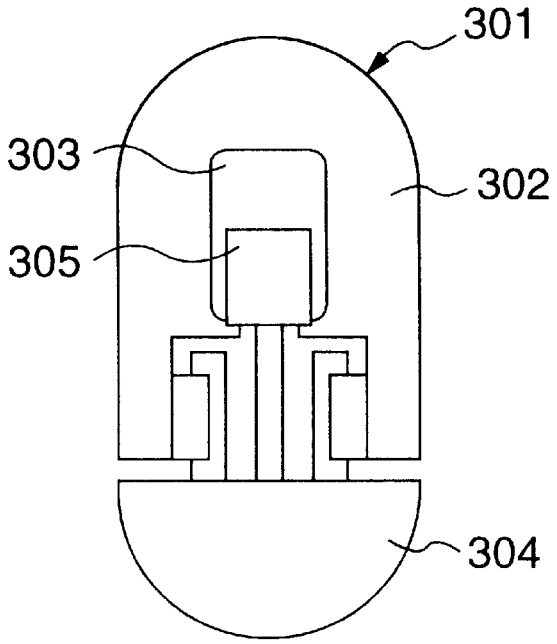
FIG. 11 is a sectional view showing a second conventional mandrel.

Next, the roll carriage 12 moves rightward from the position shown in FIG. 1 and both the edges of the shell material 8 is folded by rollers 12*b* as shown in step No. 3 of FIG. 9.

The roll carriage 12 further moves rightward and tightly seams both the folded edges of the shell material 8 in steps No. 4 and No. 5 of FIG. 9 to thereby form a shell 8*a*.

Next, the roll carriage 12 retracts to its original position shown in FIG. 1 and both the upper segment 1A and lower segment 1B are contracted.

The contracting action is carried out such that the screw shaft 15 is rotated by the second servo motor 30 so as to move the cam 21 rightward and the cam 22 leftward in FIG. 3. That is, since the cam 21 is screwed to the left screw thread 15*a* and the cam 22 is screwed to the right screw thread 15*b*, both the cams 21, 22 are moved in a direction in which they are separated from each other by the same amount by the rotation of the screw shaft 15 in one direction. The engaging portions 23*a*, 24*a*, 23*b*, 24*b* engaged with the cam surfaces 21*a*, 21*b*, 22*a*, 22*b* of both the cams 21, 22 are moved inward, respectively by the movement of both the cams 21, 22, so that the upper segment 1A is moved downward and the lower segment 1B is moved upward by the same amount. Therefore, the mandrel 1 is contracted in the vertical direction and an interval is made between the shell 8*a* formed by being wound around the mandrel 1 and the outer peripheral surface of the mandrel 1.

With this operation, the shell 8*a* which has been tightly wound around the outer periphery of the mandrel 1 is loosened.

Thereafter, the discharge claw member 9 moves leftward from the state shown in FIG. 1 and discharges the loosened shell 8*a* by pushing out it in a left direction in FIG. 1.

The discharged shell 8*a* is transferred to a next step located to the left side of FIG. 1 while being supported by the guide bars 10 protruding from the end surface of the upper segment 1A.

It suffices only to contract the mandrel 1 in such a small amount as to loosen the shell 8*a* with respect to the mandrel 1.

Next, after the shell 8*a* is discharged as described above, the discharge claw member 9 is returned as well as both the cams 21, 22 are moved and returned to their original positions shown in FIG. 3 by driving the second servo motor 30 in a direction opposite to the above direction.

Then, the shell material 8 is fed again and the above steps are repeated to continuously make the shells.

Next, a case that a shell whose size in the vertical direction is smaller than that of the shell formed by the above expanded mandrel 1 will be described.

Figure 6:
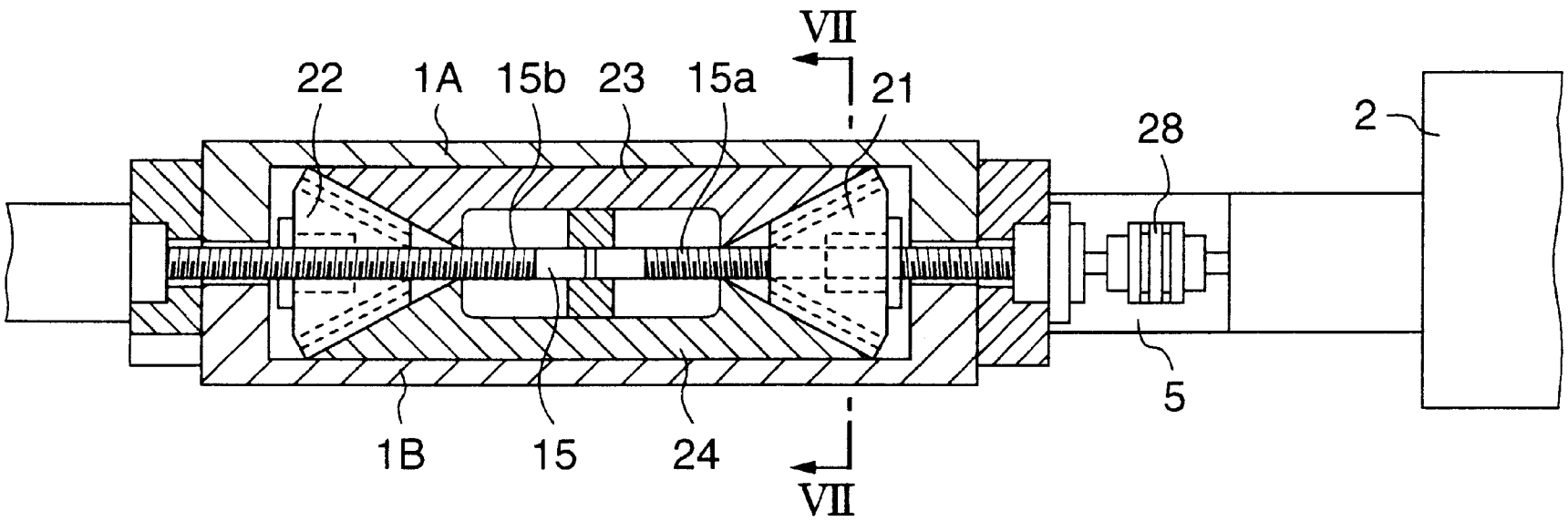
FIG. 6 is a plan sectional view of the mandrel according to the present invention and shows a contracted state of the mandrel.
Figure 7:
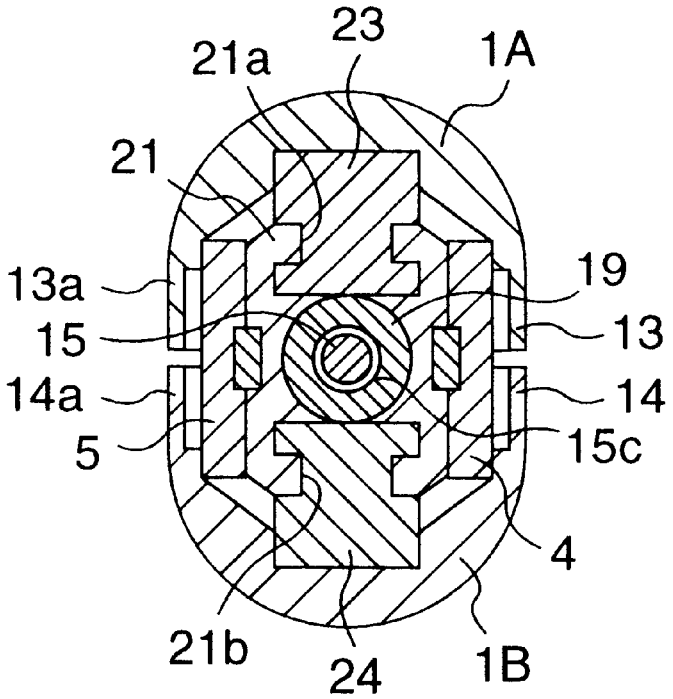
FIG. 7 is a sectional view taken along the line VII—VII in FIG. 6.

In this case, the second servo motor 30 as the rotational drive means is driven in the same direction as the direction in which the mandrel 1 is contracted as described above and rotates the screw shaft 15 to thereby move both the cams 21, 22 shown in FIG. 3 in a direction in which they are separated from each other. With this operation, both the upper segments 1A and 1B move in a direction in which they become nearer to each other, so that the diameter of the mandrel 1 is reduced in the vertical direction as shown in FIG. 6 and FIG. 7.

A shell having a diameter reduced in the vertical direction can be formed by winding the shell material 8 around the mandrel 1 in the contracted state.

Therefore, the diameter of the mandrel 1 can be set to a desired value in the long diameter direction (vertical direction) thereof by normally or reversely driving the second servo motor 30 as the rotational drive means. As a result, a shell having a different diameter in the long diameter direction can be formed by a single mandrel.

Further, although the above embodiment describes the formation of the elliptical shell, an oval shell and a circular shell can be also formed by the apparatus of the present invention, that is, by the above elliptical mandrel 1.

Figure 8:
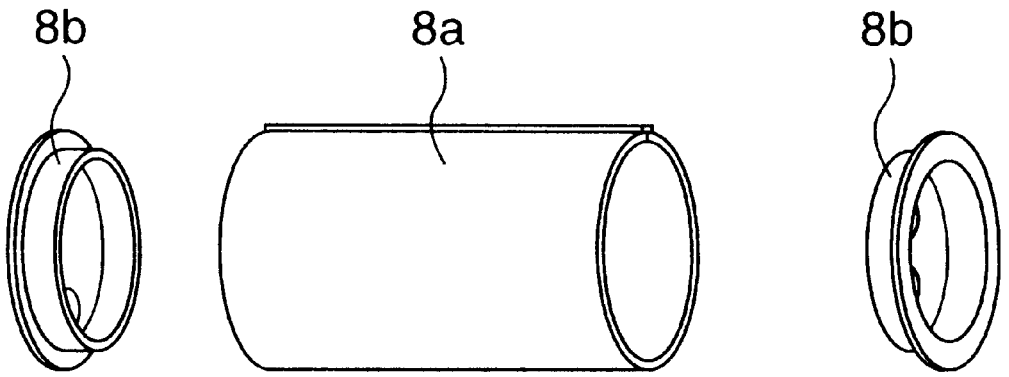
FIG. 8 is a perspective view showing the shell and end plates in a silencer.

More specifically, the shell 8*a* formed as described above is composed of a metal cylindrical body shown in FIG. 8 and has elasticity in the radial direction thereof. Further, end plates 8*b* as shown in FIG. 8 and intermediate barrier plates are engaged with the interior of the thus formed shell 8*a* in a subsequent step. Therefore, when the peripheral length of the shell 8*a* has a predetermined length, the sectional shape of the shell 8*a* can be determined by the outer peripheral shape of the end plates 8*b* and the intermediate barrier plates. As a result, even if the shell 8*a* is formed by the elliptical mandrel 1 of the above embodiment, so long as the peripheral length thereof has the predetermined length, an oval shell or a circular shell can be made by causing the shell 8*a* to be engaged with the end plates 8*b* and the intermediate barriers whose outer peripheral shape is formed to an oval or a circle.

Thus, the expansion and contraction of the mandrel 1 permit a single type of a mandrel to form shells having various diameters and various outside shapes, which dispenses with jobs for replacing a mandrel and adjusting an interval between the presser plates 6, 7 each time a different type of a shell is formed. Further, since the guide bars 10 are also moved upward and downward as the mandrel 1 is expanded or contracted, that is, as the segment 1A is moved upward or downward, a job for adjusting the position of the guide bars 10 each time a different type of a shell is formed is not needed.

Although the above embodiment describes the formation of a single-walled shell, when a double-walled shell is formed, after the shell material 8 is wound around the mandrel 1 by the above steps, the mandrel 1 is reversed by reversing the pair of support plates 4, 5 by driving the first servo motor 26 as the drive means, and thereafter another shell material is wound around the outer surface of the above wound shell in the same steps as above.

When the mandrel 1 is reversed as described above, the segment 1B is located on the upper side and the guide bars 11 provided therewith are also located on the upper side. As a result, the double-walled shell is discharged by being supported by the guide bars 11.

The servo motors 26, 30 as the rotational drive means are automatically controlled by inputting numerical values to them.

Although two cams are provided with the above embodiment, a single cam or cams more than two may be provided.

According to the first aspect of the present invention, since the upper and lower segments are moved in the direction in which they become nearer to each other or in the direction in which they are separated from each other, the outer peripheral length of the mandrel can be greatly varied by greatly expanding or contracting the mandrel in the vertical direction as compared with the conventional mandrel in which only one segment is moved. Therefore, even if a different type of a shell having a different outer peripheral length is formed, a job for replacing a mandrel is not required. Further, even if the mandrel is expanded or contracted to form a different type of a shell, since the distance between both the side surfaces of the mandrel is not changed, the interval between the presser plates for moving both the sides of the mandrel upward and downward need not be adjusted each time a different type of a shell is formed.

As a result, since a troublesome setup job is not necessary each time a different type of a shell is formed, the shell forming process can be automated, an idle time can be removed, productivity can be enhanced and a cost can be reduced.

According to the second aspect of the present invention, since the cams for expanding and contracting the mandrel are disposed in the mandrel so that they move therein in the axial direction thereof, the stroke of the cams can be made larger than that of the above conventional hydraulic mechanism, by which a different type of a shell can be easily formed by the increase of the amount of expansion and contraction of the mandrel. Further, since the mandrel can be expanded and contracted only by normally and reversely rotating the screw shaft by the rotational drive means, a mandrel expanding and contracting job can be very easily carried out.

In the conventional mandrel having a hydraulic cylinder disposed therein, although strict maintenance is necessary to prevent the leakage of hydraulic oil, the mandrel according to the present invention using the screw shaft and the cams does not need such maintenance except oiling.

According to the third aspect of the present invention, the mandrel can be more stably expanded and reduced.

According to the fourth aspect of the present invention, when the mandrel is expanded or contracted, since the guide bars also move upward and downward while maintaining a predetermined position with respect to the upper segment, the position of the guide bars need not be adjusted each time a different type of a shell is formed, by which setup can be more easily carried out.

What is claimed is:

1. A silencer shell forming apparatus in which a shell material fed below a mandrel is pushed upward at each side thereof and edges of the shell material are coupled with each other on the mandrel so that a shell is formed around an outer periphery of the mandrel,, comprising:

an upper segment and a lower segment constituting an upper portion and a lower portion of the mandrel respectively, said upper and lower segments being provided movably together; and a drive mechanism for driving said upper segment and said lower segment in a direction in which they become nearer to each other and in a direction in which they become farther from each other, said drive mechanism comprising:

a screw shaft disposed in the mandrel along the axial direction thereof, a cam member screwed to said screw shaft and having cam surfaces which are formed to the upper surface and the lower surface of said cam and inclined along the direction of the screw shaft, engaging portions formed to both of said segments and engaged with the cam surfaces, and a rotational drive mechanism provided with said screw shaft.

2. A silencer shell forming apparatus according to claim 1, wherein the screw shaft has a left screw thread and a right screw thread engraved thereto, a cam is screwed to the right screw thread and another cam is screwed to the left screw thread, both of said cams have cam surfaces formed symmetrically with each other and both of said cams are caused to become nearer to each other and separate from each other by the rotation of said screw shaft.

3. A silencer shell forming apparatus according to claim 1, wherein guide bars are disposed to the upper portion of an end surface of said upper segment on a discharge side thereof.

4. A silencer shell forming apparatus according to claim 1, wherein guide bars are disposed to the upper portion of an end surface of said upper segment on a discharge side thereof.

5. A silencer shell forming apparatus according to claim 2, wherein guide bars are disposed to the upper portion of an end surface of said upper segment on a discharge side thereof.

* * * * *